US010058757B2

(12) United States Patent
McGowan

(10) Patent No.: US 10,058,757 B2
(45) Date of Patent: Aug. 28, 2018

(54) TREE CLIMBING DEVICE

(71) Applicant: TruBlue LLC, Boulder, CO (US)

(72) Inventor: John Lewis McGowan, Boulder, CO (US)

(73) Assignee: TruBlue LLC, Boulder, CO (US)

( * ) Notice: Subject to any disclaimer, the term of this patent is extended or adjusted under 35 U.S.C. 154(b) by 0 days.

(21) Appl. No.: 14/857,266

(22) Filed: Sep. 17, 2015

(65) Prior Publication Data

US 2016/0074731 A1 Mar. 17, 2016

Related U.S. Application Data

(60) Provisional application No. 62/051,697, filed on Sep. 17, 2014.

(51) Int. Cl.

| | |
|---|---|
| ***A63B 9/00*** | (2006.01) |
| ***A63B 7/04*** | (2006.01) |
| ***A63B 69/00*** | (2006.01) |
| ***A63B 27/00*** | (2006.01) |

(52) U.S. Cl.

CPC ..... *A63B 69/0048* (2013.01); *A63B 27/00* (2013.01)

(58) Field of Classification Search

CPC ..... A63B 21/00; A63B 69/0048; A63B 27/00
USPC ..... 482/35, 37
See application file for complete search history.

(56) References Cited

U.S. PATENT DOCUMENTS

| | | | |
|---|---|---|---|
| 2,097,562 | A | 11/1937 | Day |
| 2,925,877 | A | 2/1960 | Wright |
| 3,555,747 | A | 1/1971 | Taylor |
| 4,422,527 | A | 12/1983 | Schultz et al. |
| 4,601,364 | A | 7/1986 | York |
| 4,620,610 | A | 11/1986 | Southard |
| 4,674,597 | A | 6/1987 | Humphrey |
| 4,699,347 | A | 10/1987 | Kuhnley |
| 4,869,520 | A | 9/1989 | Cole |
| 5,086,873 | A | 2/1992 | George |
| 5,507,362 | A | 4/1996 | Krueger |
| 5,810,113 | A | 9/1998 | Jones |
| 6,015,190 | A | 1/2000 | Wend |
| D427,047 | S | 6/2000 | Franklin |
| 6,074,327 | A | 6/2000 | Franklin |
| 6,095,466 | A | 8/2000 | Sener |
| D452,742 | S | 1/2002 | Takahashi |
| 6,354,400 | B1 | 3/2002 | Purkayastha |
| 6,708,832 | B1 | 3/2004 | Hannon |
| 6,942,600 | B2 | 9/2005 | Zeilinger |
| D549,356 | S | 8/2007 | Gibson |
| 7,520,837 | B1 | 4/2009 | Sudeith et al. |
| 7,520,838 | B1 | 4/2009 | Sudeith et al. |
| 7,594,874 | B2 | 9/2009 | Meissner |

(Continued)

FOREIGN PATENT DOCUMENTS

| | | |
|---|---|---|
| EP | 1949940 | 7/2008 |

OTHER PUBLICATIONS

Translation of EP 1949940.*

(Continued)

*Primary Examiner* — Loan H Thanh
*Assistant Examiner* — Megan Anderson

(57) ABSTRACT

An apparatus has a body with a contact surface configured to contact a structure. A support surface is disposed opposite the contact surface. The body defines a slot configured to receive a tension element.

18 Claims, 5 Drawing Sheets

(56) References Cited

U.S. PATENT DOCUMENTS

| | | | | |
|---|---|---|---|---|
| 7,753,170 | B1 | 7/2010 | Gibson | |
| 7,810,265 | B2 * | 10/2010 | Beatty | G09F 7/18 116/173 |
| 8,381,876 | B1 | 2/2013 | Darden | |
| 8,418,808 | B2 | 4/2013 | Merritt | |
| 9,616,295 | B2 | 4/2017 | Müller | |
| 2003/0100407 | A1 | 5/2003 | Barbafieri et al. | |
| 2004/0056527 | A1 | 3/2004 | Lance | |
| 2004/0075037 | A1 | 4/2004 | Krier | |
| 2004/0162190 | A1 | 8/2004 | Diamond et al. | |
| 2005/0109559 | A1 | 5/2005 | Eike | |
| 2005/0233863 | A1 * | 10/2005 | Zeilinger | A63B 69/0048 482/37 |
| 2005/0245355 | A1 | 11/2005 | Brewer et al. | |
| 2006/0192066 | A1 * | 8/2006 | Mills | A63B 69/0048 248/314 |
| 2007/0191188 | A1 * | 8/2007 | Collins | A63B 69/0048 482/35 |
| 2008/0017447 | A1 | 1/2008 | Sheridan | |
| 2009/0095569 | A1 | 4/2009 | Cooper | |
| 2010/0155178 | A1 | 6/2010 | Merritt | |
| 2011/0192680 | A1 | 8/2011 | Tong | |
| 2012/0080269 | A1 | 4/2012 | Furseth | |
| 2012/0199418 | A1 | 8/2012 | Priest | |
| 2013/0187018 | A1 | 7/2013 | Canfield | |
| 2013/0298379 | A1 | 11/2013 | Hansen | |
| 2014/0190767 | A1 | 7/2014 | Wheelington | |
| 2014/0291327 | A1 | 10/2014 | Messerschmidt | |
| 2015/0160537 | A1 | 6/2015 | Bier | |
| 2015/0194081 | A1 | 7/2015 | Peters | |

OTHER PUBLICATIONS

How to stop holds from spinning website:https://www.ukclimbing.com/forums/walls+training/how_to_stop_holds_spinning-39543 published: Mar. 13, 2003 Retreived: Feb. 22, 2018.*

* cited by examiner

TREE CLIMBING DEVICE

CROSS-REFERENCE TO RELATED APPLICATIONS

This application claims priority to and the benefit of U.S. Provisional Patent Application No. 62/051,697, filed Sep. 17, 2014, the disclosure of which is hereby incorporated by reference herein in its entirety.

INTRODUCTION

Recreational facilities continue to look for new opportunities for providing novel and fun opportunities to their users. One such opportunity is the use of existing trees, columns, or other structures in order to create a climbing experience for users. Such structures may be equipped with removable holds of some design to create a climbing surface. Climbers are then belayed by another climber, by an autobelay or some other device by means of a rope attached to a high point above holds in or near the tree.

SUMMARY

This disclosure describes examples of a removable hold system that may be used for climbing any tree, pole, mast, column, pillar or other structure around which a strap may be placed. In the examples, a hold is fixed to the structure through use of a strap, webbing, or cable. Depending on the example, the hold may be connected directly to the strap or indirectly by means of a mounting element, such as a mounting plate or mounting block that engages the strap.

In one aspect, the technology relates to an apparatus having: a body having a contact surface configured to contact a structure, and a support surface disposed opposite the contact surface, wherein the body at least partially defines a slot configured to receive a tension element. In an embodiment, the contact surface includes a slip-resistant element. In another embodiment, the contact surface is deformable so as to conform to the structure. In yet another embodiment, the body is deformable. In still another embodiment, the support surface at least partially defines the slot.

In another embodiment of the above aspect, the support surface at least partially defines an anchor for receiving at least one of a screw, a bolt, and a projection. In an embodiment, the support surface is substantially flat so as to contact a climbing hold, wherein the at least one of the screw, the bolt, and the projection extends from the climbing hold. In another embodiment, the climbing hold is at least one of a bar, a handle, and a simulated rock. In yet another embodiment, the support surface is a climbing hold. In still another embodiment, the body includes a tapered perimeter surface connecting the contact surface to the support surface.

In another aspect, the technology relates to an apparatus having: a ratchet; a webbing secured to the ratchet, wherein the webbing has an end adapted to be fed through the ratchet so as to tighten the webbing, and wherein the webbing defines at least one opening; and a t-nut extending through the at least one opening, wherein the t-nut is configured to be secured to a bolt. In an embodiment, the webbing includes a grommet disposed about the at least one opening. In another embodiment, the grommet includes the t-nut.

In another aspect, the technology relates to an apparatus including: a body having a face surface and a rear surface disposed opposite the face surface, wherein the body defines a slot for receiving an elongate securing element, wherein the slot extends substantially parallel to the face surface, and wherein the body defines an anchor for receiving at least one of a screw, a bolt, and a projection. In an embodiment, the rear surface includes a substantially slip-resistant element. In another embodiment, the substantially-slip resistant element includes at least one of a friction element and a toothed element. In yet another embodiment, the face surface at least partially defines the slot. In still another embodiment, the slot is configured to at least partially capture the elongate securing element so as to limit slippage of the elongate securing element.

In another embodiment of the above aspect, the body is at least partially flexible. In an embodiment, a flexible element is connected to the body.

BRIEF DESCRIPTION OF THE DRAWINGS

There are shown in the drawings, examples which are presently preferred, it being understood, however, that the technology is not limited to the precise arrangements and instrumentalities shown.

DETAILED DESCRIPTION

Figure 1A:
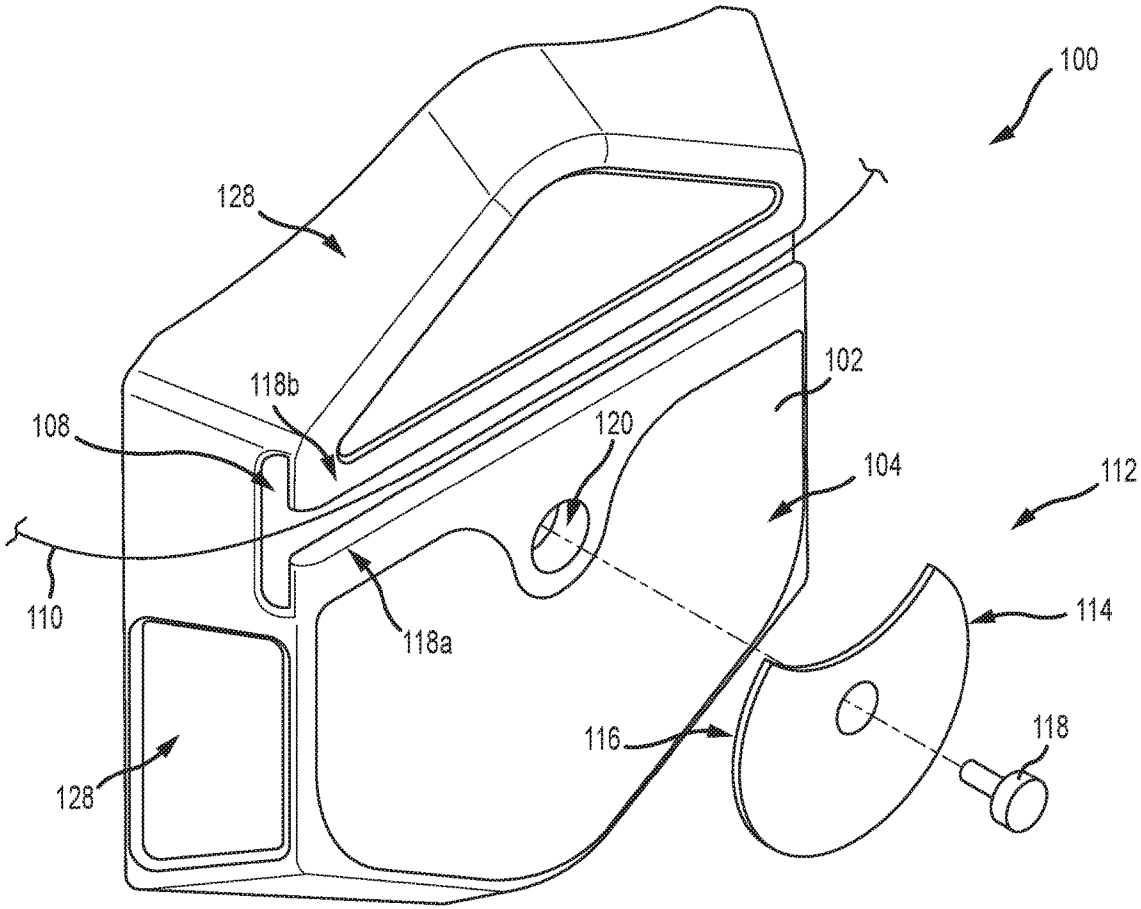
FIGS. 1A-1C depict views of removable climbing hold systems in accordance with examples of the technology.
Figure 1B:
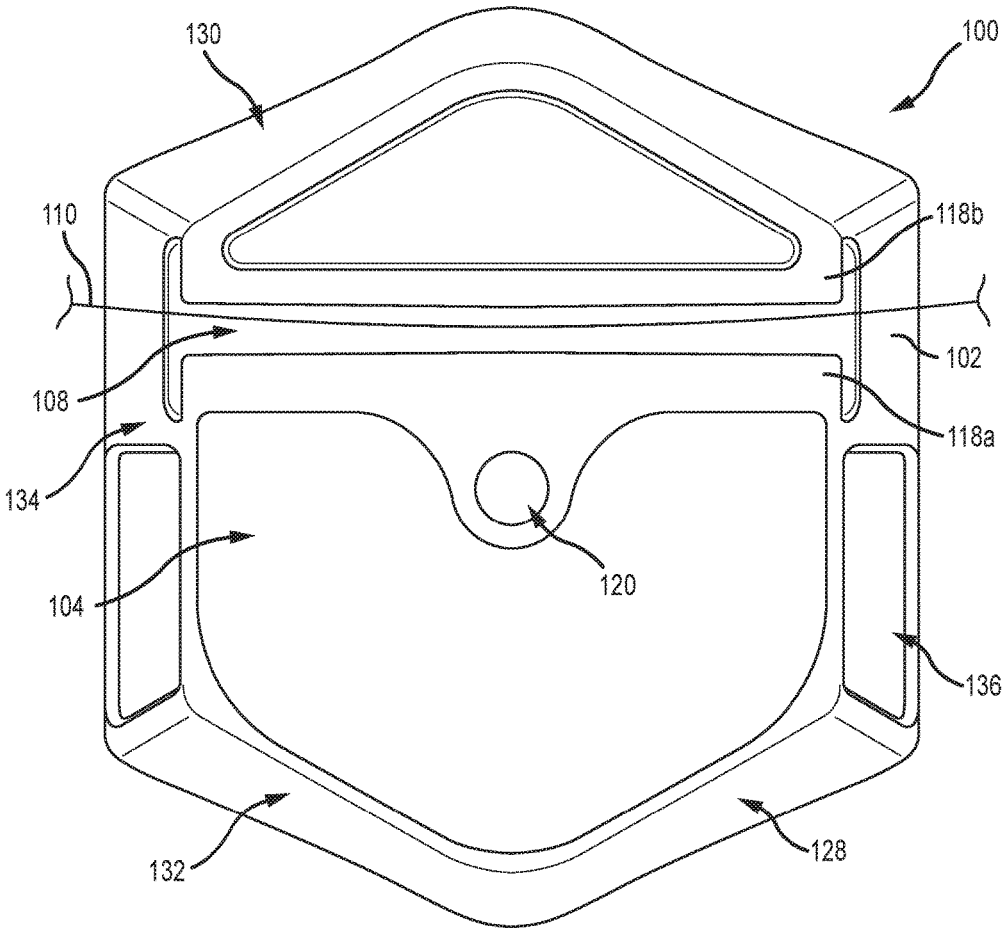
Figure 1C:
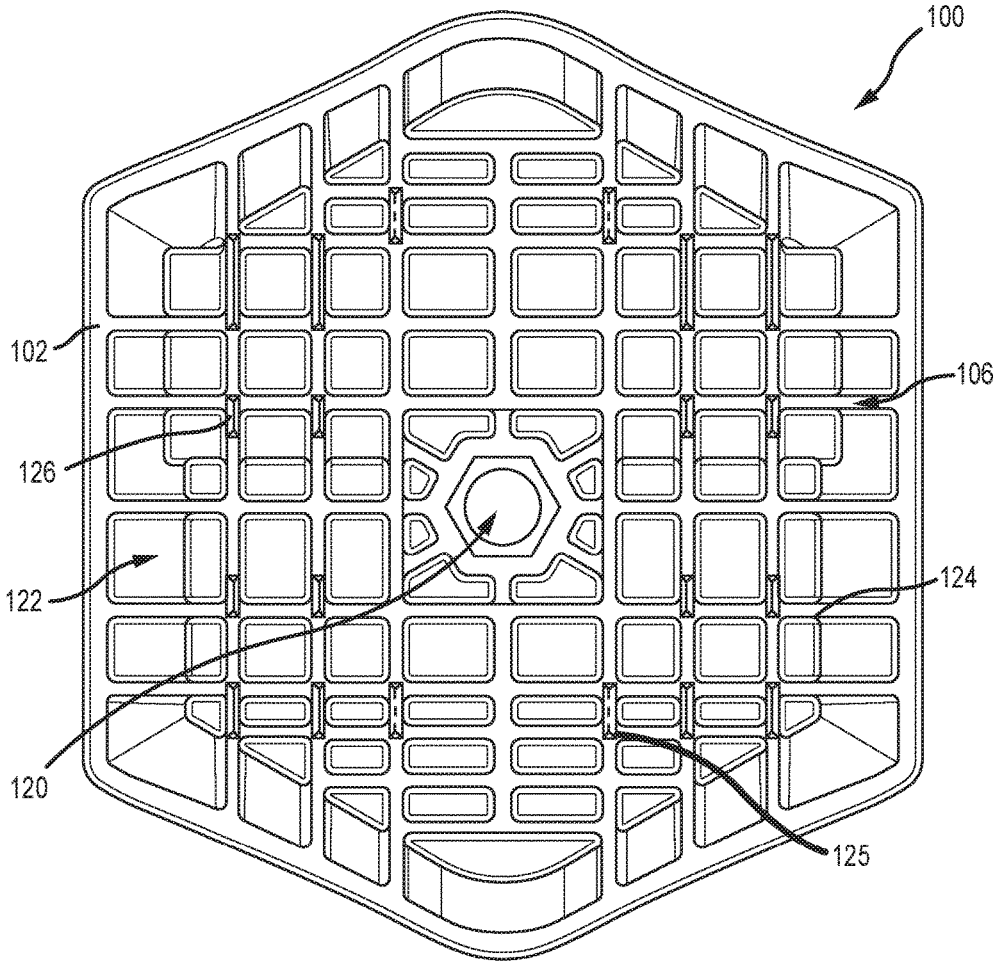

FIGS. 1A-1C depict views of a removable climbing hold system 100 in accordance with an example of the technology. FIGS. 1A-1C are described simultaneously and depict a mounting plate or body 102. The body 102 includes a front face or support surface 104 and a rear face or contact surface 106 disposed opposite therefrom. The body 102 (and in this case, the front face surface 104) defines a slot 108 for receiving an elongate tension element 110 such as a strap, webbing, or cable, which may be tightened around a support structure, such as a tree, post, column, or other structure. In examples, the elongate tension element 110 can be tightened with a ratchet, or the ends thereof may be tied, twisted, or otherwise bound together. In the example shown, a traditional climbing hold 112 having a front face 114 and flat back face 116 may be connected to the mounting body 102 via a screw or bolt 118. The bolt 118 extends into an anchor 120 defined by the front surface 104 of the body 102. The anchor 120 may be internally threaded or can be sized to snugly fit a projection extending from the hold 112. The mounting body 102 as shown is a unitary element made of a single molded or 3D printed piece of polymer plastic or, alternatively, a unitary metal construction. Mounting plates of multiple pieces may also be used. In other examples, bodies of flexible plastics may be utilized, so as to deform and conform to the shape of the support structure to which the body 102 is secured.

The mounting body 102 is illustrated with the slot 108 in the form of a channel that crosses the face surface 104 of the body 102. An elongate element such as a strap 110 may be placed within the channel and then tightened, fixing the body 102 to a location on the support structure. In the example shown, lips 118*a*, 118*b* at the top and bottom of the slot 108 provide further protection against the strap 110 separating from the body 102 when the strap 110 is tightened. Multiple slots 108 may be provided, thus allowing the body 102 to be used with multiple straps, straps of different sizes, or to allow the body 102 to be installed with a different configuration relative to the strap 110.

In the example shown, the body 102 has a flat front surface 104 for engaging the back face 116 of the hold 112. In another example, the front surface 104 may be complementary to the back surface 116 of the hold 112. The front surface 104 may be smooth or textured to prevent unintentional rotation of the hold 112 during use. In another example, grip tape may be disposed on the face to limit or prevent rotation of the hold 112. In yet another example, a stud or projection (not shown) may be provided on either the hold 112 or the body 102, for engaging one of a set of complementary receptacles (also not shown) in the other component, allowing the hold 112 to be positively installed in one of a number of different configurations on the body 102.

In the example shown, the rear contact surface 106 is adapted to engage the support structure or surface. The contact surface 106 may define a slight curvature and may include a plurality of recesses 122 and several exposed structural supports 124. In an example, a separate friction element 125, such as a texture, a flexible gel surface, a flexible rubber surface, or other deformable surface may be provided on the contact surface 106 to increase friction and improve contact with the structure so as to reduce slippage. Other slip-resistant elements can include teeth 126 that project from the structural supports 124.

The body 102 illustrated further has a plurality of perimeter surfaces 128. For example, the perimeter surfaces 128 can include a top surface 130, a bottom surface 132, and two side surfaces 134, 136. The perimeter surfaces 128 are sloped or tapered from the contact surface 106 to the front surface 104 so that the perimeter surface 128 does not provide a usable handhold by itself. In an example, some or all of the perimeter surfaces 128 may be made smooth or curved to further prevent their use as a climbing surface. In alternative examples, the perimeter surfaces 128 may be contoured or includes dimples, recesses, or holes, so as to enable their use as a climbing surface.

Figure 2:
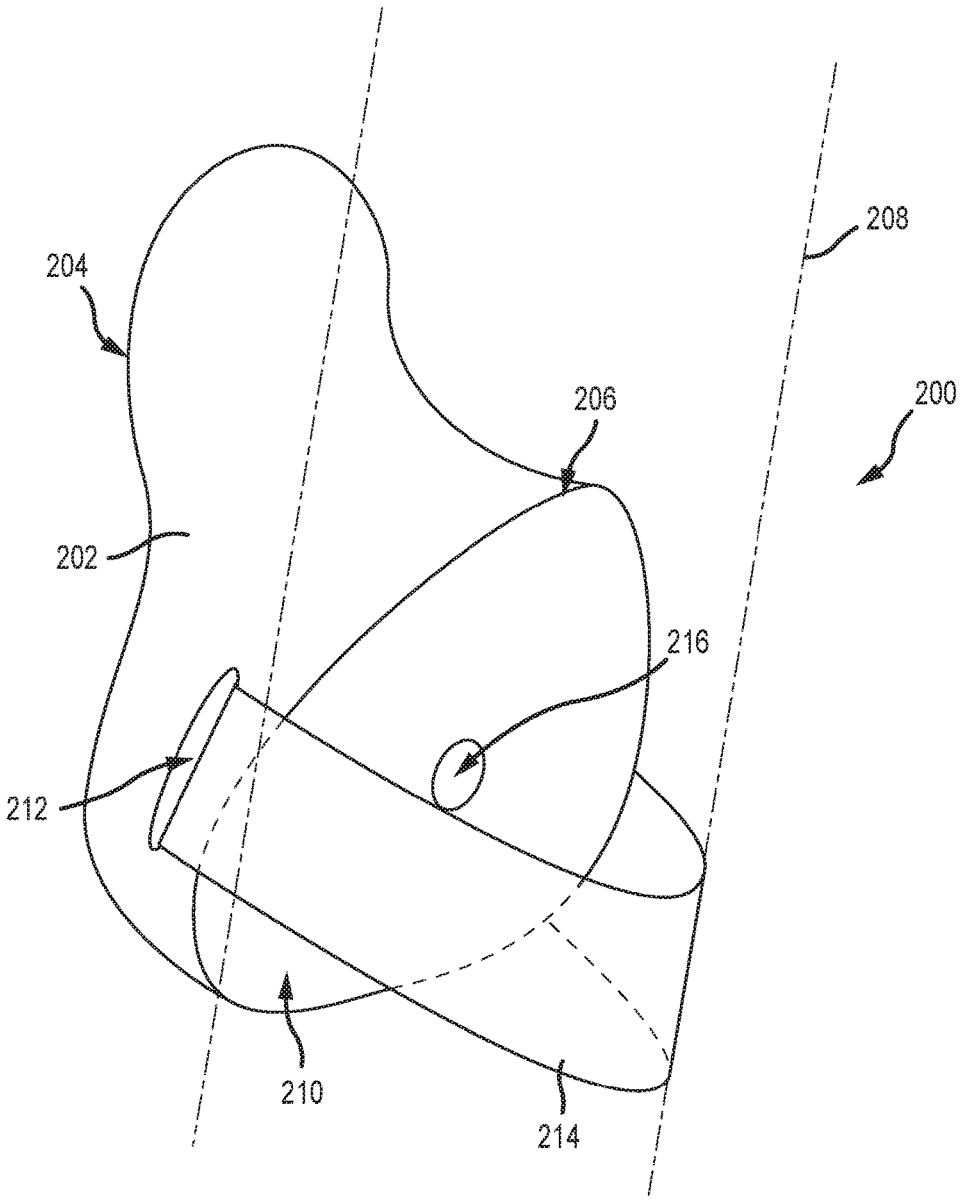
FIG. 2 depicts a rear perspective view of a removable climbing hold system in accordance with another example of the technology.

FIG. 2 depicts a rear perspective view of a removable climbing hold system 200 in accordance with another example of the technology. In the embodiment shown, a body 202 is manufactured in the form of a molded resin handhold having a front face 204 for use as a climbing surface and a rear face 206, also referred to as the "base", adapted to engage a tree, column, or other structure 208 (shown in dashed lines for clarity). The front face 204 may have any shape suitable for grasping by a climber and may be larger or smaller depending on the intended difficulty of the climbing experience. In one example, the body 202 may be a sloping knob that provides an easily-gripped surface. In a non-recreational embodiment, the hold may be a bar, handle, or other very positive grasping element. The rear face 206 of the body 202 may be flat or may be curved slightly or extensively to create a better contact with the support structure 208. The rear face 206 includes a slip-resistant element 210, in the form of a pad having a surface texture, a gel surface, or a rubber surface that may improve contact with the structure 208. If the structure 208 is a tree, this element 208 may help reduce trauma to the tree bark.

In the example shown, the body 202 is in the form factor of a handhold that differs in several aspects from those handholds found on traditional climbing walls. For example, the body 202 includes a strap slot 212 or hole extending therethrough that is substantially parallel to the rear face 206 of the body 202. The strap slot 212 is substantially vertically oriented for receiving a strap 214, which is secured about the structure 208. The strap slot 212 also may be straight or may follow a curved or non-linear path through the body 202 as required or desired for a particular application.

After the strap 214 is passed through the slot 212 in the body 202, the strap 214 is wrapped around the structure 208 and tightened. In an example, to protect the structure 208, the strap 214 is of a synthetic material and is a ratchet strap having a permanently attached ratchet at one end and an opposite free end for engaging with the ratchet. The ratchet is not depicted for clarity. Tightening is achieved by passing the free end through the ratchet and working the ratchet arm to take up slack and, ultimately, tighten and lock the strap 214 in place. However, any method of tightening and locking the strap 214 may be used, such as by tying a knot, by using a friction lock, or by any other suitable method. In addition, the strap 214 need not be a flat strap but could be any type of cord, cable, rope, strap, wire, band, or other flexible or semi-flexible elongate element. Depending on the cross-sectional shape of the strap 214 used, the shape of the slot 212 in the body 202 may be complementary.

In an alternative example, more than one strap slot may be provided in a body 202, thus allowing the body 202 to be mounted in different configurations, or mounted with multiple straps or multiple wraps of the same strap. In such an example, multiple slots may penetrate each other or may overlap each other within the body. The body 202 may also include a central horizontal hole (a "bolt hole") from the front face 204 to the rear face 206 of the body 202 in addition to the strap slot 212 described above. The hole 216 may be configured to receive a bolt, thus allowing the body 202 to be used also as a hold on a traditional climbing wall, if desired.

Internal supporting elements may be provided in the body 202 in order to provide added strength to the body 202 when in a particular use. For example, a metal component such as a bearing plate or metal tube may be incorporated into the body 202 as part of the slot 212 or the bolt hole 216 in order to reduce the stress on the resin portion of the body 202.

Figure 3:
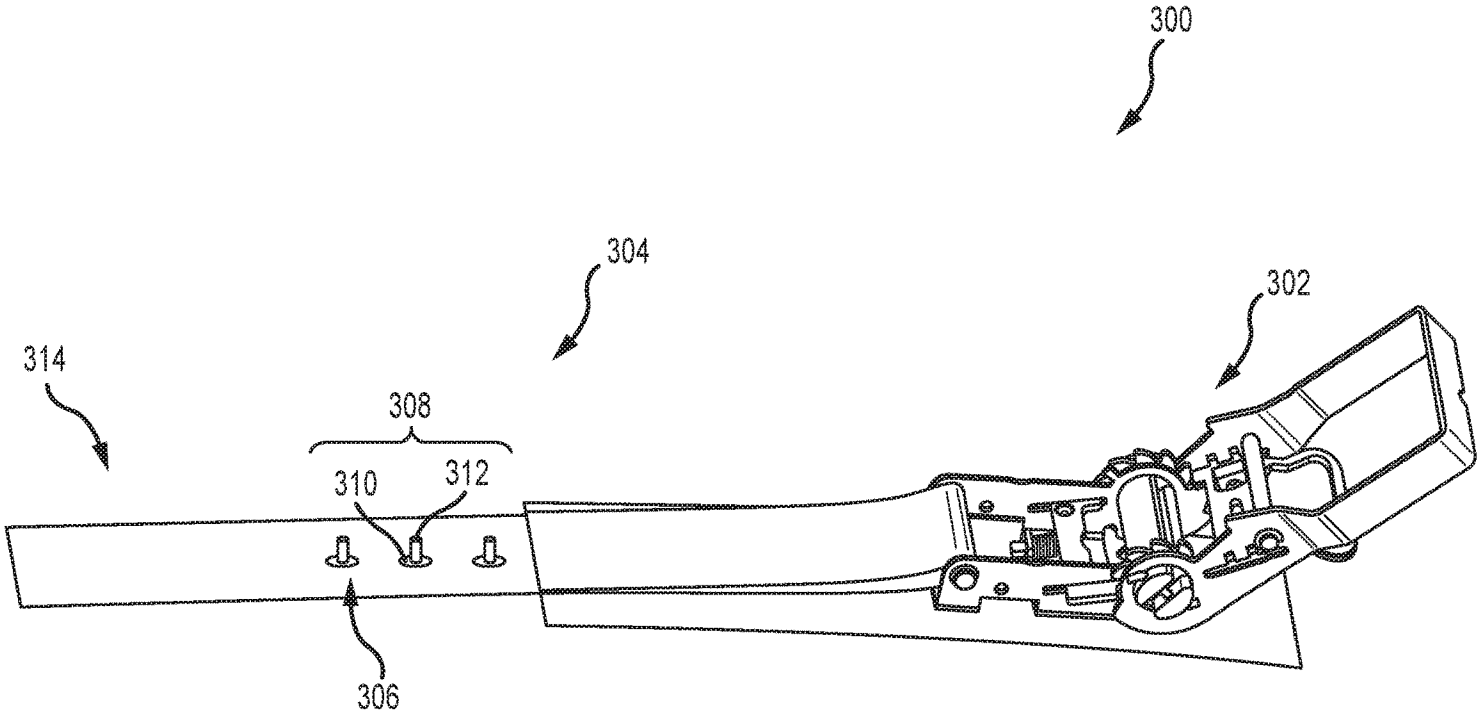
FIG. 3 depicts a perspective view of a removable climbing hold system in accordance with another example of the technology.

FIG. 3 depicts a perspective view of a removable climbing hold system 300 in accordance with another example of the technology. In this example, a ratchet 302 is used in conjunction with a strap 304. The ratchet 302 may be the same type of ratchet 302 used to secure the example systems of FIGS. 1A-2. Unlike the ratchets used with those systems, however, the depicted system 300 may be used on its own to removably secure climbing holds to a support. The strap 304 defines one or more holes 306 in a section 308 of the strap 304. Typically, the section 308 will be positioned such that it will not be drawn into the ratchet 302. In the embodiment shown, each hole 306 is defined by a grommet 310. A t-nut 312 may extend through or be integral with the grommet 310. Holds may be attached to the t-nut 312 via a bolt that penetrates the hold and engages therewith such as depicted in FIG. 1A. The strap 304 can then be mounted to the structure and tightened with the ratchet 302. Any other suitable means for fixing the hold to the strap may be used, such as rivets and pins.

The one or more holes 306 are provided in the hold attachment section 308 of the strap 304. The hold attachment section 308 may extend for only a portion of the strap 304. In an example, the strap 304 is approximately 10 feet long and the ratchet 302 is provided at one end. Next to the ratchet is an approximate three foot hold attachment section 308 of the strap 304 having attachment holes 306 every three to six inches. The remaining section 314 of the strap 304 may be provided without holes to facilitate engagement with the ratchet 302. In an alternative embodiment, the hold attachment section 308 may have only a single hole 306 located a distance from an end of the strap.

It will be clear that the systems and methods described herein are well adapted to attain the ends and advantages mentioned as well as those inherent therein. Those skilled in the art will recognize that the methods and systems within this specification may be implemented in many manners and as such is not to be limited by the foregoing exemplified embodiments and examples. In other words, functional elements being performed by a single or multiple components, in various combinations, may be combined in a single component or separated into multiple components. In this regard, any number of the features of the different embodiments described herein may be combined into one single embodiment and alternate embodiments having fewer than or more than all of the features herein described are possible.

It is to be understood that this disclosure is not limited to the particular structures, process steps, or materials disclosed herein, but is extended to equivalents thereof as would be recognized by those ordinarily skilled in the relevant arts. It should also be understood that terminology employed herein is used for the purpose of describing particular examples only and is not intended to be limiting. It must be noted that, as used in this specification, the singular forms "a," "an," and "the" include plural referents unless the context clearly dictates otherwise.

It will be clear that the systems and methods described herein are well adapted to attain the ends and advantages mentioned as well as those inherent therein. Those skilled in the art will recognize that the methods, devices, and systems within this specification may be implemented in many manners and as such is not to be limited by the foregoing exemplified examples and examples. In this regard, any number of the features of the different examples described herein may be combined into one single example and alternate examples having fewer than or more than all of the features herein described are possible.

This disclosure described some examples of the present technology with reference to the accompanying drawings, in which only some of the possible examples were shown. Other aspects may, however, be embodied in many different forms and should not be construed as limited to the examples set forth herein. Rather, these examples were provided so that this disclosure was thorough and complete and fully conveyed the scope of the possible examples to those skilled in the art.

Although specific examples were described herein, the scope of the technology is not limited to those specific examples. One skilled in the art will recognize other examples or improvements that are within the scope and spirit of the present technology. Therefore, the specific structure, acts, or media are disclosed only as illustrative examples. The scope of the technology is defined by the following claims and any equivalents therein.

What is claimed is:

1. An apparatus comprising:

a body comprising:

a contact surface configured to contact a structure;

a support surface disposed opposite the contact surface; and a perimeter surface extending between the contact surface and the support surface, wherein the perimeter surface comprises a top surface, a bottom surface, and two opposing side surfaces, wherein the body at least partially defines a slot configured to receive a tension element, the slot extending between the two opposing side surfaces, wherein the body defines an anchor for receiving at least one of a screw, a bolt, or a projection, wherein the contact surface includes a slip-resistant element, the slip-resisting element comprising one or more teeth projecting from the contact surface, and wherein at least a portion of the support surface comprises grip tape configured to restrict rotation of a climbing hold coupled thereto.

2. The apparatus of claim 1, wherein the contact surface is deformable so as to conform to the structure.

3. The apparatus of claim 2, wherein the body is deformable.

4. The apparatus of claim 1, wherein the support surface at least partially defines the anchor.

5. The apparatus of claim 4, wherein the support surface is substantially flat so as to contact the climbing hold, wherein the at least one of the screw, the bolt, or the projection extends from the climbing hold.

6. The apparatus of claim 1, wherein the support surface at least partially defines the slot.

7. The apparatus of claim 1, wherein at least a portion of the perimeter surface comprises at least one of a contour, a dimple, a recess, or a hole.

8. The apparatus of claim 1, wherein the contact surface comprises a plurality of structural supports.

9. The apparatus of claim 1, wherein at least a portion of the perimeter surface tapers inwards from the contact surface to the support surface.

10. An apparatus comprising:

a body comprising:

a face surface, wherein at least a portion of the face surface comprises a textured surface configured to restrict rotation of a climbing hold coupled thereto, and wherein the textured surface comprises grip tape;

a rear surface disposed opposite the face surface; and a perimeter surface comprising a top surface, a bottom surface, and two side surfaces, wherein the body defines a slot for receiving an elongate securing element, the slot extending between the two side surfaces, wherein the slot extends substantially parallel to the face surface, and wherein the body defines an anchor for receiving at least one of a screw, a bolt, or a projection.

11. The apparatus of claim 10, wherein the rear surface includes a substantially slip-resistant element.

12. The apparatus of claim 11, wherein the substantially slip-resistant element includes at least one of a friction element and a toothed element.

13. The apparatus of claim 10, wherein the body is at least partially flexible.

14. The apparatus of claim 13, further comprising a flexible element connected to the body.

15. The apparatus of claim 10, wherein the face surface at least partially defines the slot.

16. The apparatus of claim 10, wherein the slot is configured to at least partially capture the elongate securing element so as to limit slippage of the elongate securing element.

17. The apparatus of claim 10, further comprising one or more teeth extending from the rear surface.

18. The apparatus of claim 10, wherein the perimeter surface tapers inward from the face surface to the rear surface.

* * * * *